US009901220B2

(12) United States Patent
Yasui

(10) Patent No.: US 9,901,220 B2
(45) Date of Patent: Feb. 27, 2018

(54) POCKET TISSUE

(71) Applicant: DAIO PAPER CORPORATION, Ehime (JP)

(72) Inventor: Shuta Yasui, Shizuoka (JP)

(73) Assignee: DAIO PAPER CORPORATION, Ehime (JP)

( * ) Notice: Subject to any disclaimer, the term of this patent is extended or adjusted under 35 U.S.C. 154(b) by 0 days.

(21) Appl. No.: 15/025,039

(22) PCT Filed: Jan. 27, 2015

(86) PCT No.: PCT/JP2015/052095
§ 371 (c)(1),
(2) Date: Mar. 25, 2016

(87) PCT Pub. No.: WO2015/115389
PCT Pub. Date: Aug. 6, 2015

(65) Prior Publication Data

US 2016/0256020 A1 Sep. 8, 2016

(30) Foreign Application Priority Data

Jan. 31, 2014 (JP) ..... 2014-016399

(51) Int. Cl.
*A47K 10/42* (2006.01)
*B65D 83/08* (2006.01)
*B65D 85/62* (2006.01)

(52) U.S. Cl.
CPC ..... *A47K 10/421* (2013.01); *B65D 83/0805* (2013.01); *B65D 83/0894* (2013.01); *B65D 85/62* (2013.01); *A47K 2010/428* (2013.01)

(58) Field of Classification Search
CPC ..... A47K 2010/428; A47K 10/421; B25H 45/24; B25H 45/12; B65D 83/0805; B65D 85/02; B31D 5/04
(Continued)

(56) References Cited

U.S. PATENT DOCUMENTS 2,002,691 A * 5/1935 Cofrin ..... A47K 10/16 206/494
5,516,000 A 5/1996 Freiburger et al.
(Continued)

FOREIGN PATENT DOCUMENTS

CN 2333637 Y 8/1999
CN 1269316 A 10/2000
(Continued)

OTHER PUBLICATIONS

Japanese Office Action dated Apr. 14, 2015 in corresponding Japanese Application No. 2014-016399; 5 pgs.
(Continued)

*Primary Examiner* — Steven A. Reynolds
(74) *Attorney, Agent, or Firm* — Maier & Maier, PLLC

(57) ABSTRACT

A pocket tissue includes a stack of paper tissues each of which is folded at a plurality of fold portions and a film package that contains the stack, the pocket tissue allowing the paper tissues to be taken out from a dispense opening formed in an upper surface of the package. Each of the paper tissues includes a first fold portion located at a position that substantially bisects the paper tissue, a second fold portion extending in a longitudinal direction of the paper tissue folded at the first fold portion, and a third fold portion extending in a transverse direction of the paper tissue folded at the second fold portion. The stack is formed by stacking the paper tissues each of which has been folded at the third fold portion to be in a state in which the first fold portion is exposed to the outside.

3 Claims, 4 Drawing Sheets

(58) Field of Classification Search
USPC ..... 206/233, 494; 428/130, 126
See application file for complete search history.

(56) References Cited

U.S. PATENT DOCUMENTS

| | | | | | |
|---|---|---|---|---|---|
| 5,736,224 | A * | 4/1998 | Dodge | A47G 11/001 | 428/153 |
| 6,012,572 | A * | 1/2000 | Heathcock | B65D 83/0894 | 206/233 |
| 6,296,144 | B1 * | 10/2001 | Tanaka | B65D 83/0894 | 206/494 |
| 6,880,704 | B2 * | 4/2005 | Bredahl | B65D 75/5838 | 206/233 |
| 8,689,528 | B1 * | 4/2014 | Gaspari | B65D 83/0894 | 206/494 |
| 2002/0038805 | A1 * | 4/2002 | Iida | A47K 10/421 | 221/45 |
| 2002/0139813 | A1 * | 10/2002 | Boone | A47K 10/424 | 221/289 |
| 2010/0055391 | A1 * | 3/2010 | Penfield | A47G 11/001 | 428/126 |
| 2014/0057069 | A1 * | 2/2014 | Huang | A47K 10/42 | 428/126 |

FOREIGN PATENT DOCUMENTS

| | | | |
|---|---|---|---|
| CN | 2598871 | Y | 1/2004 |
| DE | 9106555 | U1 | 9/1991 |
| EP | 1044894 | A1 | 10/2000 |
| FR | 02772009 | A1 | 6/1999 |
| JP | 2007-244568 | A | 9/2007 |
| JP | 2013-000196 | A | 1/2013 |
| JP | 2013-111328 | A | 6/2013 |
| JP | 2013-177181 | A | 9/2013 |
| JP | 2014-234220 | A | 12/2014 |
| WO | 03024842 | A1 | 3/2003 |

OTHER PUBLICATIONS

Japanese Decision to Grant dated Jul. 7, 2015 in corresponding Japanese Application No. 2014-016399; 5 pgs.
International Search Report of corresponding PCT/JP2015/052095 dated Mar. 31, 2015.
Extended European Search Report dated Feb. 10, 2017, in connection with corresponding EP Application No. 15743605 (8 pgs.).
Chinese Office Action dated Nov. 28, 2016, in connection with corresponding CN Application No. 201580002138.8 (12 pgs., including English translation).
Decision of Refusal dated Aug. 18, 2017 of corresponding Chinese application No. 201580002138.8; 17 pgs.

* cited by examiner

POCKET TISSUE

FIELD

Embodiments of the present invention relates to a pocket tissue.

BACKGROUND

Existing pocket tissues have a structure in which a stack of plies of folded paper tissues are packed in a bag-shaped resin film package and a paper tissue can be taken out through a slit-shaped dispense opening, which is formed at substantially the center of a package upper surface in the transverse direction and which extends in the longitudinal direction.

However, as illustrated in FIG. 5, with existing pocket tissues, a paper tissue is folded in half along the transverse direction of a package upper surface after having been folded a plurality of times along the longitudinal direction of the package upper surface when contained in the package. Therefore, there is a problem in that, in order to make a paper tissue taken out from the package into an easily-usable shape, such as a folded-in-half shape, it takes effort to, for example, temporarily spread and then refold the paper tissue.

Accordingly, for example, there have been proposed pocket tissues in which each of rectangular paper tissues is only folded a plurality of times along the transverse direction of the package upper surface (for example, see PTLs 1 and 2). With the inventions described in PTLs 1 and 2, a paper tissue taken out through the dispense opening has appropriate size and shape, so that the paper tissue can be used without refolding.

CITATION LIST

Patent Literature

PTL 1: Japanese Unexamined Patent Application Publication No. 2013-111328

PTL 2: Japanese Unexamined Patent Application Publication No. 2013-177181

SUMMARY

However, with the inventions described in PTLs 1 and 2, when a user takes out one of the stacked rectangular paper tissues by picking an end portion of a short side of the paper tissue or a fold portion of the paper tissue, the paper tissue may be torn along a fold portion. To prevent this, it is necessary to increase the strength of the paper tissue itself. Accordingly, there is a problem in that it is difficult to use a paper tissue that has good usability but has low strength, such as a paper tissue including a moisturizing component.

An object of the present invention is to provide a pocket tissue that allows a folded paper tissue to be easily taken out from a package and to be used immediately after having been taken out and that has good usability.

To solve the problem, embodiments of the invention is a pocket tissue including a stack of paper tissues each of which is folded at a plurality of fold portions and a film package that contains the stack, the pocket tissue allowing the paper tissues to be taken out from a dispense opening formed in an upper surface of the package, wherein each of the paper tissues includes a first fold portion located at a position that substantially bisects the paper tissue, a second fold portion extending in a longitudinal direction of the paper tissue folded at the first fold portion, and a third fold portion extending in a transverse direction of the paper tissue folded at the second fold portion, and wherein the stack is formed by stacking the paper tissues each of which has been folded at the third fold portion to be in a state in which the first fold portion is exposed to the outside.

Embodiments of the invention can further include that, the first fold portion of each of the paper tissues that has been folded at the second fold portion is disposed parallel to the dispense opening and near the dispense opening.

Embodiments of the invention can further include that, each of the paper tissues is folded at two of the third fold portions, which are located at substantially the same distance from both end portions of the first fold portion and are perpendicular to the first fold portion, so that both end portions are opposed to each other, and each of the paper tissues is contained in the package in a state in which both end portions that are opposed to each other face a surface opposite the dispense opening.

Embodiments of the invention can further include that, in the stack, the paper tissues are stacked so that positions of the second fold portions of the paper tissues alternately change between one end portion and the other end of portion of the stack in the transverse direction.

ADVANTAGEOUS EFFECTS OF INVENTION

Embodiments of the present invention, because a paper tissue can be taken out in a folded-in-half state, a user need not spread and then refold the paper tissue that has been taken out and can use the paper tissue as it is.

Moreover, because a paper tissue is taken out in a folded-in-half state, in which the second fold portion and the third fold portion are perpendicular to each other, the paper tissue has a high strength and is not easily torn while being taken out. Therefore, even if the strength of the paper tissue itself is lower than existing paper tissues, the paper tissue is not easily torn while being taken out, and the pocket tissue has good usability.

DESCRIPTION OF EMBODIMENTS

Figure 1:
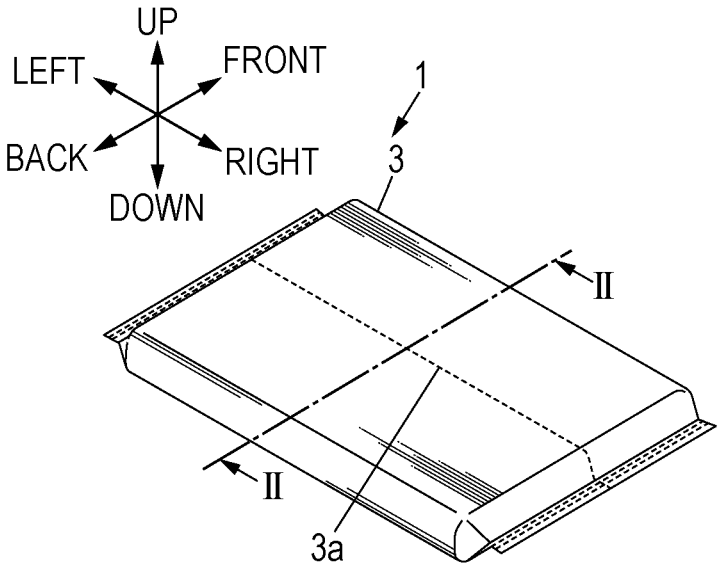
FIG. 1 is a perspective view illustrating a pocket tissue according to an embodiment of the present invention.

Hereinafter, embodiments of the present invention will be described in detail with reference to the drawings. Note that the scope of the invention is not limited to examples illustrated in the drawings.

In the following description, the thickness direction of a pocket tissue 1 illustrated in FIG. 1 is defined as the up-down direction, a short side of the upper surface of the pocket tissue 1 extends in the front-back direction (the transverse direction), and a direction perpendicular to both of the up-down direction and the front-back direction is defined as the left-right direction (the longitudinal direction).

Figure 2:
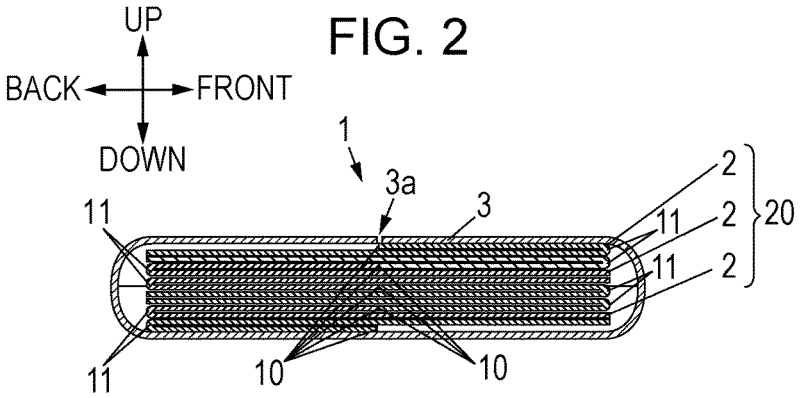
FIG. 2 is a cross-sectional view taken along line II-II of FIG. 1.

As illustrated in FIG. 1, the pocket tissue 1 according to the present embodiment has, for example, a substantially rectangular-parallelepiped shape that is elongated in the left-right direction. As illustrated in FIG. 2, the pocket tissue 1 includes a stack 20 in which a plurality of paper tissues 2 are stacked and a package 3 that contains the paper tissues 2.

Each of the paper tissues 2 has a ply-structure in which two or three pieces of thin paper are stacked.

The material pulp of the thin paper is a mixture of NBKP and LBKP. Although the material pulp may include an appropriate amount of recycled pulp, preferably, the material pulp includes only NBKP and LBKP in view of texture and the like. In this case, the composition of the material is preferably, NBKP:LBKP=20:80 to 80:20, and more preferably, NBKP:LBKP=30:70 to 60:40.

The basis weight of a piece of thin paper included in each ply of the paper tissues 2 according to the present invention is preferably in the range of 9 to 25 g/m$^2$, and more preferably in the range of 10 to 15 g/m$^2$. If the basis weight is less than 9 g/m$^2$, although preferable in view of improvement in softness, it is difficult to properly obtain a sufficient strength that allows the paper tissue to be usable. Conversely, if the basis weight is greater than 25 g/m$^2$, the entirety of the paper is rigid and has stiffness and a rough texture. The basis weight is measured by using a method in accordance with JIS P 8124 (1998).

Preferably, the thickness of the paper tissue 2 according to the present invention in a 2-ply state is in the range of 100 to 160 μm, and more preferably in the range of 120 to 140 μm. If the thickness is less than 100 μm, although preferable in view of improvement in softness, it is difficult to properly obtain a sufficient strength as a paper tissue. If the thickness is greater than 160 μm, the paper tissue has a rough texture and a user feels stiffness during use.

The paper thickness is measured, after sufficiently moisturizing test pieces under the conditions according to JIS P 8111 (1998), by using a dial thickness gauge (thickness measurement device) "PEACOCK G-type" (made by OZAKI MFG. CO., LTD.) under the same conditions. The paper thickness of each ply of paper tissues is measured, without separating the paper tissues.

To be specific, after checking that there is no dirt, dust, or the like between a plunger and a measurement table, the plunger is lowered to the measurement stage, the dial of the dial thickness gauge is moved to adjust the zero point. Then, the plunger is raised, a test piece is placed on the test stage, the plunger is gradually lowered, and the gauge at this time is read. At this time, the plunger is just placed on the test piece. The plunger has a terminal portion made of a metal and having a flat circular surface that has a diameter of 10 mm and that perpendicularly contacts a paper surface, and a load at the time of measuring the thickness is about 70 gf when the thickness is 120 μm. The thickness is the average obtained by performing the measurement ten times.

The paper tissue 2 is, for example, a moisturizing paper tissue made by impregnating thin paper with medical solution mainly including a moisturizing agent in a predetermined ratio.

The moisturizing agent may be any moisturizing agent that is generally used. Specific examples include polyhydric alcohols, such as glycerol, diglycerol, propylene glycol, 1,3-butylene glycol, and polyethylene glycol; saccharides, such as sorbitol, glucose, xylitol, maltose, maltitol, mannitol, and trehalose; glycol-based agents and their derivatives; polyols containing higher alcohols such as cetanol, stearyl alcohol, and oleyl alcohol; and liquid paraffin. One of these agents can be used, or two or more of these agents can be used in combination. The moisturizing agent may further include, for example, any of the following substances: amino acids, such as glycine, aspartic acid, arginine, alanine, cystine, and cysteine; plant extracts, such as aloe extract, hydrangea extract, angelica extract, quince extract, cucumber extract, field horsetail extract, tomato extract, rosa canina extract, luffa extract, lily extract, and astragalus extract; plant oils, such as olive oil, jojoba oil, rosehip oil, almond oil, eucalyptus oil, avocado oil, camellia oil, soybean oil, safflower oil, sesame oil, and evening primrose oil; vitamin; hydrolytic collagen; hydrolytic keratin; hydrolytic silk; chitosan; urea; honey; royal jelly; sodium hyaluronate; ceramid; scualane; and vaseline.

The present invention can be also applied to wet tissues.

The package 3 may be any package that is used for ordinary pocket tissues. To be specific, the package 3 is made of, for example, a thermoplastic resin film, such as a polyethylene film or a polypropylene film.

A dispense opening 3*a* is formed in the upper surface of the package 3, and a user can take out the paper tissues 2 one by one by inserting his/her fingers into the dispense opening 3*a* and picking one of the paper tissues 2 contained in the package 3.

For example, as illustrated in FIG. 1, the dispense opening 3*a* is a slit that is formed by tearing the upper surface of the package 3 along a perforation line, which is formed in a substantially central portion in the transverse direction so as to extend between both ends of the upper surface in the longitudinal direction.

Hereinafter, referring to FIGS. 3A to 3C, a method of folding the paper tissue 2 to be contained in the pocket tissue 1 according to the present embodiment will be specifically described.

Figure 3A:
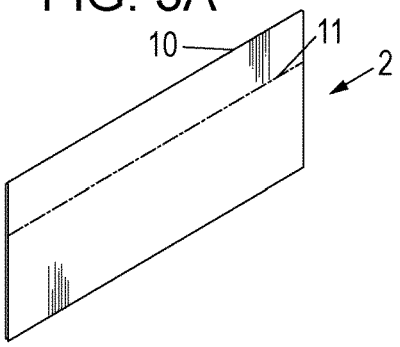
FIG. 3A is a perspective view illustrating an example of a state in which a paper tissue according to the embodiment of the present invention is folded at a first fold portion.

As illustrated in is FIG. 3A, the paper tissue 2 is folded in half at a first fold portion 10, which is located at a position that substantially bisects the paper tissue 2.

Figure 3B:
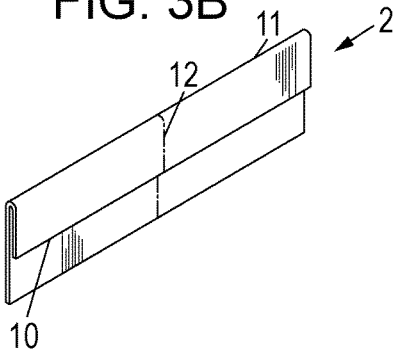
FIG. 3B is a perspective view illustrating an example of a state in which the paper tissue shown in FIG. 3A is folded at a second fold portion.

The paper tissue 2, which has been folded in half, is folded further at a second fold portion 11 extending in the longitudinal direction (FIG. 3B). Finally, the paper tissue 2 is folded at a third fold portion 12, extending in the transverse direction of the paper tissue, into a shape such that the first fold portion 10 faces outward as illustrated in FIG. 3C.

As illustrated in FIG. 2, the paper tissues 2, each of which has been folded by the method described above, are stacked and contained in the package 3 so that the positions of the second fold portions 11 alternately change between one end portion and the other end portion of the stack 20 in the front-back direction, that is, the first fold portions 10 are alternately opposed to each other and the first fold portions 10 are disposed parallel to the dispense opening 3*a* and near the dispense opening 3*a*.

When using the pocket tissue 1 according to the present embodiment, a user can pull out the paper tissue 2 easily by picking a part of the first fold portion 10 with his/her fingers, because the first fold portion 10 is disposed parallel to the dispense opening 3*a* and near the dispense opening 3*a*.

While a user picks and pulls out the first fold portion 10, a force is applied to the paper tissue 2 in such a direction that the second fold portion 11 and the third fold portion 12 are stretched due to frictional resistance between the dispense opening 3*a* and the paper tissue 2. Therefore, when completely pulled out from the package 3, the paper tissue 2 has a folded-in-half shape that can be easily used.

Figure 3C:
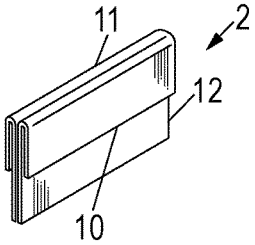
FIG. 3C is a perspective view illustrating an example of a state in which the paper tissue shown in FIG. 3B is folded at a third fold portion.

As illustrated in FIG. 3C, the folded paper tissue 2 has a thin portion and a thick portion. However, as illustrated in FIG. 2, because the stack 20 is formed so that the thin portions and thick portions alternately overlap each other, the thickness of the entirety of the pocket tissue 1 is appropriately uniform.

Modification

Figure 4A:
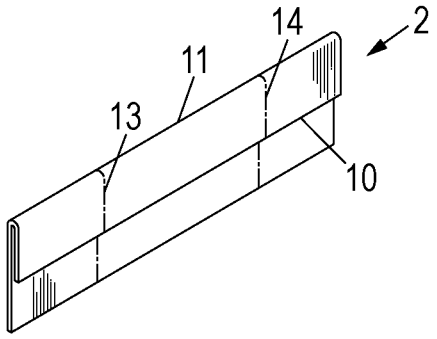
FIG. 4A is a perspective view illustrating an example of a state in which a paper tissue according to a modification of the present invention is folded at a first fold portion and a second fold portion.
Figure 4B:
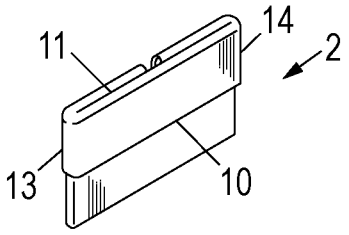
FIG. 4B is a perspective view illustrating an example of a state in which the paper tissue shown in FIG. 4A is folded at third fold portions.
Figure 5:
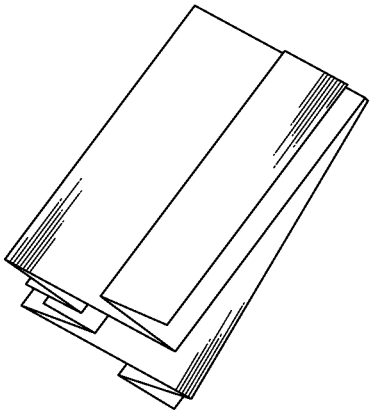
FIG. 5 PRIOR ART
FIG. 5 is a perspective view illustrating a state in which a paper tissue of an existing pocket tissue has been folded.

FIGS. 4A and 4B illustrate a modification of the method of folding the paper tissue 2.

In the present modification, the paper tissue 2 is folded at the first fold portion 10 and the second fold portion 11 in the same way as in the present embodiment (FIGS. 3A and 3B), and then is folded at third fold portions 13 and 14 (FIG. 4A) that are located at substantially the same distance from both the left and right end portions of the first fold portion 10 and are perpendicular to the first fold portion 10. Thus, as illustrated in FIG. 4B, the paper tissue 2 has such a shape that the first fold portion 10 faces outward and both end portions of the first fold portion 10 are opposed to each other at a position overlapping a central portion of the first fold portion 10.

As with the paper tissue 2 according to the present embodiment, the paper tissues 2, each of which has been folded by the method according to the present modification, are stacked and contained in the package 3 so that the positions of the second fold portions 11 alternately change between one end portion and the other end portion of the stack 20 in the front-back direction, that is, the first fold portions 10 are alternately opposed to each other, the first fold portions 10 are disposed parallel to the longitudinal direction of the dispense opening 3*a* and near the dispense opening 3*a*, and both end portions of the first fold portion 10 that are opposed to each other face a surface opposite the dispense opening 3*a*.

Also when using the pocket tissue 1 according to the present modification, a user can pull out the paper tissue 2 by picking the first fold portion 10 with his/her fingers. When completely pulled out from the package 3, the paper tissue 2 has a folded-in-half shape that can be easily used.

In the present modification, a distance over which a user has to move the paper tissue 2 from a position at which the user picks the first fold portion 10 to a position at which the paper tissue 2 is completely pulled out from the package 3 is shorter than that of the embodiment. Therefore, the paper tissue 2 can be pull out more easily and a force applied to each fold portion can be further reduced. As a result, the paper tissue 2 is more unlikely to be torn.

As illustrated in FIG. 4B, the folded paper tissue 2 has a thin portion and a thick portion. However, as illustrated in FIG. 2, because the stack 20 is formed so that the thin portions and the thick portions alternately overlap each other, the thickness of the entirety of the pocket tissue 1 is appropriately uniform.

The pocket tissue 1 according to the present invention described above allows a user to take out the paper tissue 2 in a folded-in-half state. Therefore, a user need not spread and then refold the paper tissue and can use the paper tissue 2 as it is.

Because the paper tissue 2 is folded in half at the first fold portion and is further folded at the second fold portion 11 and at the third fold portions 12, 13, and 14, the paper tissue 2 has a high strength and is not easily torn while being taken out. An excessive force is not applied to a fold portion, and, even if the strength of the paper tissue itself is lower than that of existing paper tissues, the paper tissue is not easily torn while being taken out. Therefore, the pocket tissue 1 is particularly suitable for soft paper tissues, such as lotion paper tissues.

Because the paper tissue 2 is taken out by picking the first fold portion 10, which is folded in half, a plurality of pieces of thin paper that are stacked in the paper tissue 2 are not separated from each other, so that the paper tissue 2 can be easily taken out.

The present invention is not limited to the embodiment and the modification described above, which can be modified as necessary within the spirit and scope of the present invention.

The paper tissues 2 may be contained so that the longitudinal direction of the dispense opening 3*a* is perpendicular to the direction of fibers of the paper tissue 2. In this case, when pulling out the paper tissue 2 by picking the first fold portion 10, a force is applied to the paper tissue 2 in a direction parallel to the direction of the fibers. Accordingly, the strength in the pulling direction is increased and the paper tissue 2 is more unlikely to be torn when taken out, and the usability is further improved.

INDUSTRIAL APPLICABILITY

With a pocket tissue according to the present invention, a paper tissue is not easily torn when a user takes out the paper tissue, and the user can use the paper tissue, which has been taken out, without spreading and refolding the paper tissue. Therefore, the pocket tissue can be used particularly as a pocket tissue that has high usability.

REFERENCE SIGNS LIST

1 pocket tissue
2 paper tissue
3 package
3*a* dispense opening
10 first fold portion
11 second fold portion
12, 13, 14 third fold portion
20 stack

The invention claimed is:

1. A pocket tissue, comprising:

a stack of paper tissues, each of which is folded at a plurality of fold portions and a film package that contains the stack, the pocket tissue allowing the paper tissues to be taken out from a dispense opening formed in an upper surface of the package, wherein each of the paper tissues includes a first fold portion located at a position that substantially bisects the paper tissue, and includes a first fold along the first fold portion, the first fold defining a first folding stage;

wherein each of the paper tissues further includes a second fold portion extending in a longitudinal direction of the paper tissue folded at the first fold portion, the second fold portion separated from the first fold portion by a transverse distance of one third of a transverse length of the first folding stage, and includes a second fold along the second fold portion, the second fold defining a second folding stage including the first folding stage; and wherein each of the paper tissues further includes a plurality of third fold portions extending in a transverse direction of the paper tissue folded at the second fold portion, and includes a plurality of third folds, each of the third folds along a third fold portion in the plurality of third fold portions, the plurality of third fold portions defining a third folding stage including the second folding stage, wherein only a single second folding stage is provided prior to the third folding stage;

wherein the stack is formed by stacking the paper tissues each of which has been folded first at the first fold portion, second at the second fold portion, and finally at one or more of its third fold portions to be in a state in which the first fold portion is exposed to the outside, wherein each of the paper tissues is folded at two of its third fold portions, the third fold portions being located at substantially the same distance from both end portions of the first fold portion and being perpendicular to the first fold portion, so that both end portions are opposed to each other, and wherein each of the paper tissues is contained in the package in a state in which both end portions that are opposed to each other face a surface opposite the dispense opening.

2. The pocket tissue according to claim 1, wherein the first fold portion of each of the paper tissues that has been folded at the second fold portion is disposed parallel to the dispense opening and near the dispense opening.

3. The pocket tissue according to claim 1, wherein, in the stack, the paper tissues are stacked so that positions of the second fold portions of the paper tissues alternately change between one end portion and the other end portion of the stack in the transverse direction.

* * * * *